US011851989B2

(12) United States Patent
Almarri et al.

(10) Patent No.: US 11,851,989 B2
(45) Date of Patent: Dec. 26, 2023

(54) COOLING METHODOLOGY TO IMPROVE HYDRAULIC FRACTURING EFFICIENCY AND REDUCE BREAKDOWN PRESSURE

(71) Applicant: SAUDI ARABIAN OIL COMPANY, Dhahran (SA)

(72) Inventors: Misfer J. Almarri, Dammam (SA); Murtadha J. AlTammar, Al Olaya (SA); Khalid Mohammed Alruwaili, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/457,516

(22) Filed: Dec. 3, 2021

(65) Prior Publication Data

US 2023/0175354 A1 Jun. 8, 2023

(51) Int. Cl.

| | |
|---|---|
| ***E21B 36/00*** | (2006.01) |
| ***E21B 43/26*** | (2006.01) |
| ***E21B 47/07*** | (2012.01) |

(52) U.S. Cl.
CPC ..... *E21B 36/001* (2013.01); *E21B 43/2607* (2020.05); *E21B 47/07* (2020.05)

(58) Field of Classification Search
CPC ..... E21B 36/001; E21B 43/2607; E21B 47/07
See application file for complete search history.

(56) References Cited

U.S. PATENT DOCUMENTS 2,772,737 A * 12/1956 Bond ..... C09K 8/64 166/57
3,047,068 A * 7/1962 Hanson ..... E21B 43/26 166/302

(Continued)

FOREIGN PATENT DOCUMENTS

AU 2013213760 A1 8/2013
CA 2908618 A1 10/2014

(Continued)

OTHER PUBLICATIONS

Almarri, Misfer, "Efficient History Matching of Thermally Induced Fractures Using Coupled Geomechanics and Reservoir Simulation", Energies, MDPI, vol. 13, No. 3001, Jun. 2020, pp. 1-43 (43 pages).

(Continued)

*Primary Examiner* — Jonathan Malikasim
(74) *Attorney, Agent, or Firm* — Osha Bergman Watanabe & Burton LLP

(57) ABSTRACT

A method for reducing breakdown pressure at a formation includes detecting a tight reservoir formation in a well and providing hydraulic fracturing equipment assembled together as a hydraulic fracturing system at a surface of the well. The hydraulic fracturing system includes a fluid source containing a base fluid and fluidly connected to a blender and a pump and manifold system fluidly connecting an outlet of the blender to a wellhead of the well. The method further includes connecting a cooling system to the hydraulic fracturing system, using the cooling system to cool the base fluid to a cooled base temperature upstream of the pump and manifold system, pumping the cooled base fluid down the well to the tight reservoir formation, and using the cooled base fluid to lower a temperature of the tight reservoir formation and reduce a breakdown pressure of the tight reservoir formation.

20 Claims, 8 Drawing Sheets

(56) References Cited

U.S. PATENT DOCUMENTS

| | | | | |
|---|---|---|---|---|
| 3,193,014 | A | 7/1965 | Hill | |
| 3,195,634 | A * | 7/1965 | Hill | E21B 43/2605 166/308.1 |
| 3,396,107 | A * | 8/1968 | Hill | C09K 8/62 166/308.2 |
| 3,842,910 | A * | 10/1974 | Zingg | E21B 43/26 166/308.1 |
| 4,191,266 | A * | 3/1980 | van Eek | E21B 33/10 175/7 |
| 4,589,491 | A | 5/1986 | Perkins | |
| 4,705,113 | A * | 11/1987 | Perkins | E21B 36/001 166/308.1 |
| 7,458,424 | B2 * | 12/2008 | Odeh | C09K 8/506 166/293 |
| 7,571,766 | B2 | 8/2009 | Pauls et al. | |
| 7,730,951 | B2 | 6/2010 | Surjaatmadja et al. | |
| 7,980,312 | B1 | 7/2011 | Hill et al. | |
| 8,689,876 | B2 | 4/2014 | Loree et al. | |
| 9,920,608 | B2 | 3/2018 | van Oort et al. | |
| 10,428,263 | B2 * | 10/2019 | Babcock | C09K 8/64 |
| 10,557,668 | B2 * | 2/2020 | Zikeli | F28D 7/08 |
| 10,648,305 | B2 * | 5/2020 | Ayirala | C09K 8/594 |
| 2005/0211439 | A1 | 9/2005 | Willett et al. | |
| 2006/0201674 | A1 | 9/2006 | Soliman et al. | |
| 2007/0125544 | A1 * | 6/2007 | Robinson | E21B 43/26 166/305.1 |
| 2010/0243242 | A1 | 9/2010 | Boney et al. | |
| 2011/0061869 | A1 | 3/2011 | Abass et al. | |
| 2012/0118568 | A1 | 5/2012 | Kleefisch | |
| 2016/0160619 | A1 | 6/2016 | Randall | |
| 2018/0266183 | A1 | 9/2018 | Ayub | |
| 2021/0363868 | A1 | 11/2021 | Almarri et al. | |

FOREIGN PATENT DOCUMENTS

| | | | |
|---|---|---|---|
| CA | 2913609 | A1 | 5/2017 |
| CN | 109882143 | A | 6/2019 |
| CN | 111735708 | A | 10/2020 |
| WO | 2018017110 | A1 | 1/2018 |
| WO | 2019027489 | A1 | 2/2019 |
| WO | 2022/103398 | A1 | 5/2022 |

OTHER PUBLICATIONS

Almarri, Misfer, "Identification and characterization of Thermally Induced Fractures through integrated analytical and semi-analytical models", Journal of Petroleum Science and Engineering, ScienceDirect, Elsevier B.V., vol. 196, No. 107930, 2021, Available Online Oct. 2020, pp. 1-20 (20 pages).

Al-Nakhli, Ayman, et al., "Reducing Breakdown Pressure of Tight Reservoirs Via in-Situ Pulses: Impact of Mineralogy", SPE-196540-MS, Society of Petroleum Engineers, Oct. 2019, pp. 1-12 (12 pages).

AlTammar, Murtadha J., et al., "Application of Different Fluid Injection Methods to Reduce Breakdown Pressure", IPTC-19589-MS, International Petroleum Technology Conference, Jan. 2020, pp. 1-14 (14 pages).

Briner, Andreas, et al., "Impact of Wellbore Completion Type on Fracture Initiation Pressure in Maximum Tensile Stress Criterion Model for Tight Gas Field in the Sultanate of Oman", IPTC-18261-MS, International Petroleum Technology Conference, Dec. 2015, pp. 1-12 (12 pages).

Chavez, Juan, et al., "Formation Breakdown Prediction for the Implementation of Hydraulic Fracturing on a HPHT Tight Gas Reservoir in Oman", SPE 164012, Society of Petroleum Engineers, Jan. 2013, pp. 1-8 (8 pages).

Gomaa, Ahmed M., et al., "New Insights into Hydraulic Fracturing of Shale Formations", IPTC 17594, International Petroleum Technology Conference, Jan. 2014, pp. 1-17 (17 pages).

Ibrahim, Ahmed Farid and Hisham Nasr-El-Din, "Evaluation of the Breakdown Pressure to Initiate Hydraulic Fractures of Tight Sandstone and Shale Formations", SPE-191245-MS, Society of Petroleum Engineers, Jun. 2018, pp. 1-19 (19 pages).

Josifovic, Aleksandar, et al., "Reducing the environmental impact of hydraulic fracturing through design optimisation of positive displacement pumps", Energy, ScienceDirect, Elsevier Ltd., vol. 115, 2016, pp. 1216-1233 (18 pages).

Oparin, Maksim, et al., "Impact of Local Stress Heterogeneity on Fracture Initiation in Unconventional Reservoirs: A Case Study from Saudi Arabia", SPE-181617-MS, Society of Petroleum Engineers, Sep. 2016, pp. 1-18 (18 pages).

Sakhaee-Pour, A. and Abhishek Agrawal, "Predicting Breakdown Pressure and Breakdown Cycle in Cyclic Fracturing", SPE 191137, SPE Production & Operations, Society of Petroleum Engineers, Nov. 2018, pp. 761-769 (9 pages).

"Super Insulated Tank", Chassis King, Access Date: Dec. 1, 2021, URL: <http://www.chassisking.com/products/tank-containers/super-insulated-tank/> (1 page).

Vilarrasa, V., "The role of the stress regime on microseismicity induced by overpressure and cooling in geologic carbon storage", Geofluids, John Wiley & Sons Ltd., vol. 16, No. 5, Dec. 2016, pp. 941-953 (14 pages).

International Search Report and Written Opinion issued in related International Application No. PCT/US2021/033032, dated Aug. 9, 2021 (14 pages).

Office Action issued in related U.S. Appl. No. 16/878,446, dated Nov. 24, 2021 (10 pages).

Cai, C., et al., "A Waterless Fracturing Treatment: Liquid Nitrogen Fracturing and Its Application Prospect", SOCAR Proceedings, No. 3, 2015, pp. 35-40 (6 pages).

Goodarzi, S., et al., "Thermal Aspects of Geomechanics and Induced Fracturing in CO2 Injection with Application to CO2 Sequestration in Ohio River Valley", SPE-139706, Society of Petroleum Engineers, Nov. 2010, pp. 1-8 (8 pages).

Enayatpour, Saeid, et al., "Thermal cooling to improve hydraulic fracturing efficiency and hydrcarbon production in shales", Journal of Natural Gas Science and Engineering, ScienceDirect, Elsevier B.V., vol. 62, 2019, Available Online Dec. 2018, pp. 184-201 (18 pages).

Abass, H.H., et al., "Oriented Fracturing: A New Technique to Hydraulically Fracture Openhole Horizontal Well", SPE 124483, Society of Petroleum Engineers, Oct. 2009, pp. 1-12 (12 pages).

Chang, Frank F., et al., "Multiple Fracture Initiation in Openhole Without Mechanical Isolation: First Step to Fulfill an Ambition", SPE-168638, Society of Petroleum Engineers, Feb. 2014, pp. 1-18 (18 pages).

Andrade, A., et al., "Thermal Induced Fracture Effect with a Lower Cool down Reduction—Case Studies for Ecuador Villano and CPF Water Disposal Wells", Society of Petroleum Engineers, Nov. 2015, pp. 1-21 (21 pages).

Bartko, Kirk, et al., "First Application for a Sequenced Fracturing Technique to Divert Fractures in a Vertical Open Hole Completion: Case Study from Saudi Arabia", SPE-179127-MS, Society of Petroleum Engineers, Feb. 2016, pp. 1-15 (15 pages).

Kayumov, Rifat, et al., "Efficient Large Volume Acid Fracturing in Openhole Horizontal Well with Pre-Created Circular Notches", SPE-194779-MS, Society of Petroleum Engineers, Mar. 2019, pp. 1-14 (14 pages).

International Search Report and the Written Opinion of the International Searching Authority dated Mar. 27, 2023, issued in the International (PCT) Application No. PCT/US2022/051641 (14 Pages).

* cited by examiner

COOLING METHODOLOGY TO IMPROVE HYDRAULIC FRACTURING EFFICIENCY AND REDUCE BREAKDOWN PRESSURE

BACKGROUND

Hydraulic fracturing is an oil field production technique that involves injecting a pressurized fluid to artificially fracture subsurface formations. For example, pressurized hydraulic fracturing fluids may be pumped into a subsurface formation to be treated, causing fractures to open in the subsurface formation. The fractures may extend away from the wellbore according to the natural stresses within the formation. Proppants, such as grains of sand, may be provided with the pressurized hydraulic fracturing fluid, which may lodge into the hydraulically created fractures to keep the fracture open when the treatment pressure is released. The proppant-supported fractures may provide high-conductivity flow channels with a large area of formation to enhance hydrocarbon extraction.

Fracturing fluid is typically pumped downhole at a very high fracturing pressure, e.g., greater than 9,000 psi, in order to fracture the surrounding formation. Fracturing pressure refers to the pressure above which injection of fluids will cause the surrounding formation to fracture hydraulically. Similarly, breakdown pressure refers to the pressure at which fractures can be initiated. Propagation pressure may refer to pressure which may cause the fractures to extend into the rock matrix. Propagation pressure is typically lower than breakdown pressure. Thus, hydraulic fracturing operations include pumping fracturing fluid at a pressure greater than the breakdown pressure of a formation in order to create fractures inside the formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for reducing breakdown pressure at a formation. The method includes detecting a tight reservoir formation in a well and providing hydraulic fracturing equipment assembled together as a hydraulic fracturing system at a surface of the well. The hydraulic fracturing system includes a fluid source, containing a base fluid, fluidly connected to a blender and a pump and manifold system fluidly connecting an outlet of the blender to a wellhead of the well. The method further includes connecting a cooling system to the hydraulic fracturing system, using the cooling system to cool the base fluid to a cooled base temperature upstream of the pump and manifold system, pumping the cooled base fluid down the well to the tight reservoir formation, and using the cooled base fluid to lower a temperature of the tight reservoir formation and reduce a breakdown pressure of the tight reservoir formation.

In another aspect, embodiments disclosed herein relate to a method, which includes determining a downhole temperature at a downhole location in a well, selecting a target temperature reduction at the downhole location, calculating a temperature change of a fluid as the fluid travels from a surface of the well to the downhole location, and cooling the fluid in a hydraulic fracturing system at the surface of the well to an initial temperature based on the calculated temperature change to provide the target temperature reduction at the downhole location. The method further includes pumping the cooled fluid down the well to the downhole location and lowering the downhole temperature at the downhole location by the target temperature reduction to lower breakdown pressure at the downhole location.

In yet another aspect, embodiments disclosed herein relate to a system, which includes a hydraulic fracturing system. The hydraulic fracturing system includes a blender, a pump and manifold system fluidly connected to an outlet of the blender, and a fluid source fluidly connected to an inlet of the blender. The system further includes a cooling system connected to the hydraulic fracturing system upstream from the pump and manifold system.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
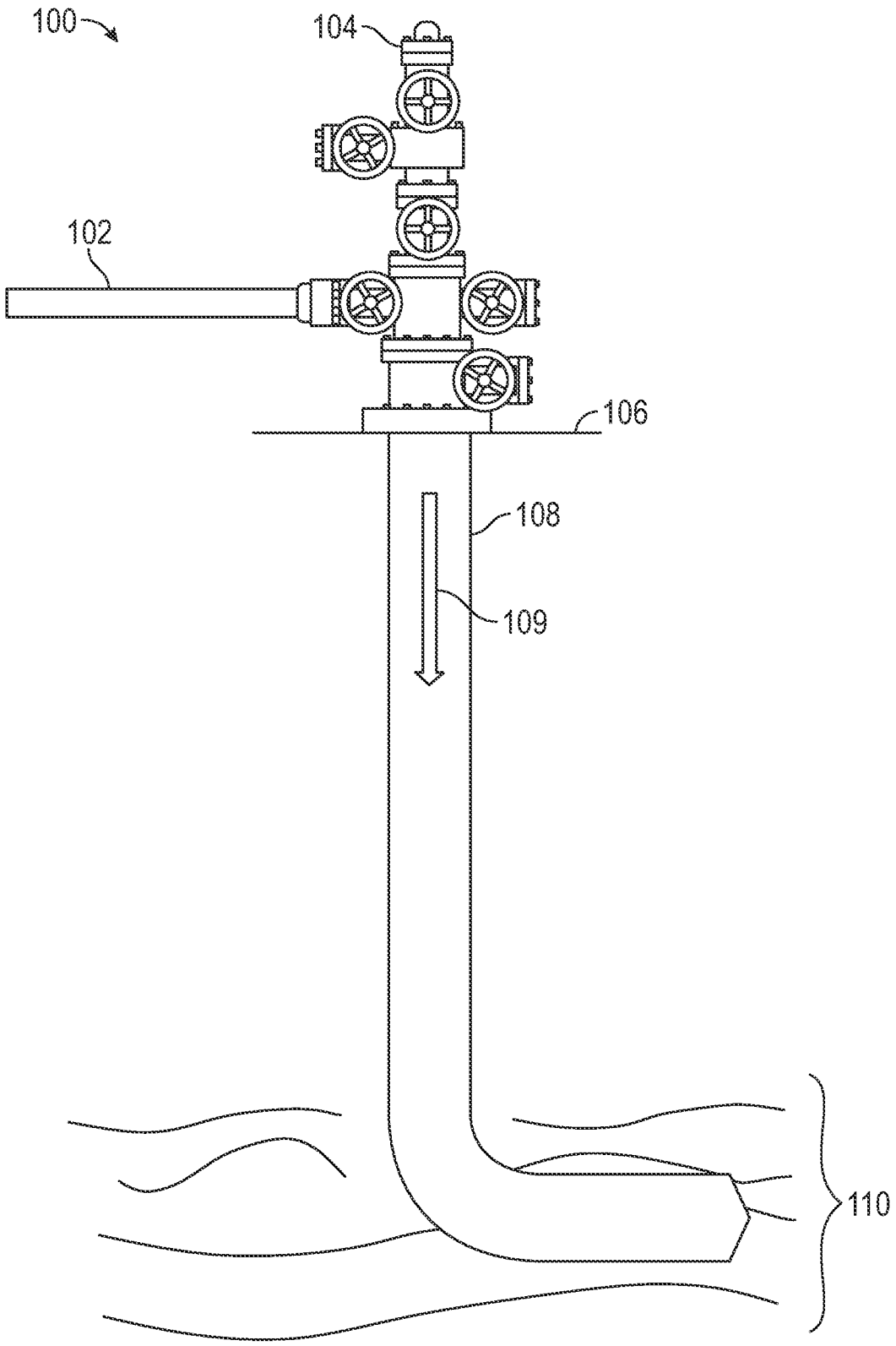
FIG. 1 shows an exemplary well in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate generally to methods and systems for injecting a cooled fluid through a well into a downhole formation to reduce the breakdown pressure of the formation. The fluid may be cooled using a cooling system provided at a hydraulic fracturing site at the surface of the well, prior to pumping the fluid downhole. Methods and systems according to embodiments of the present disclosure may be used to reduce the breakdown pressure in tight reservoir formations, which may increase hydraulic fracturing efficiency in the formations. Throughout the application, reference to tight reservoir formations may refer to a formation that includes relatively impermeable reservoir rock. A tight reservoir formation may include formations with a high Young's modulus of about 6-10 Mpsi and high minimum stress gradients in the range of 0.8-0.10 psi/ft. In one or more embodiments, tight reservoir formations may include formations having less than 1.0 millidarcy matrix permeability and less than 10% matrix porosity. In one or more embodiments, tight reservoir formations may be sandstone or carbonate formations specifically.

Deep tight gas reservoirs with over-pressured and very competent rocks can make the hydraulic fracturing operations very challenging because of high breakdown pressure. High breakdown pressure is one of the major challenges in hydraulically fracturing deep reservoirs with highly stressed regimes, low permeability, and a high pressure, high temperature (HPHT) environment. These conditions can leave a small window to break down the formation and initiate fractures due to exceeding pumping limitations or completion tubular pressure ratings. Inability to breakdown the formation can result in skipping hydraulic fracturing stages, causing an increase in the cost of operations, and a decrease in operation efficiency and hydrocarbon recovery. There have been several solutions and techniques proposed in the industry to reduce high breakdown pressure in tight gas reservoirs, including cyclic fracturing, low viscosity fracturing fluid, perforations and high pressurization rate. However, high breakdown pressure in tight gas reservoirs, such as in tight gas sandstone reservoirs, still presents a persistent challenge.

Figure 8:
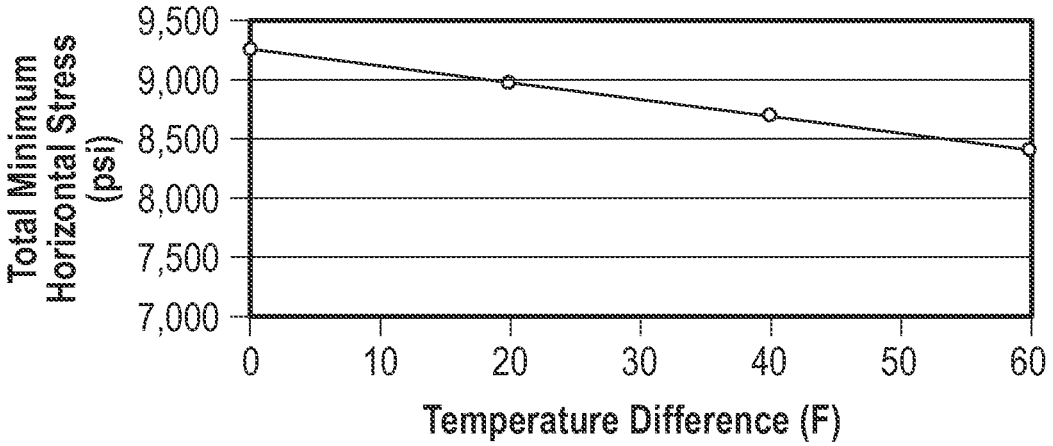
FIG. 8 shows a graph of the total minimum horizontal stress in a simulated wellbore formation as the temperature difference in the formation increases.
Figure 9:
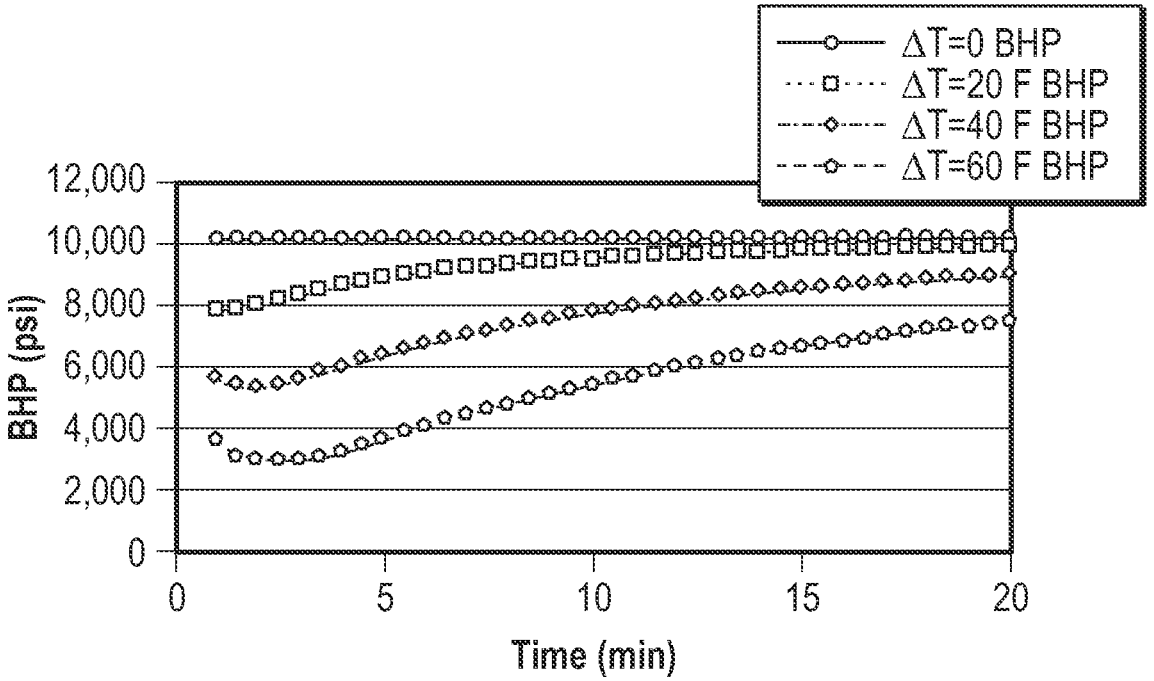
FIG. 9 shows a graph of the bottomhole pressure in a simulated well having different reductions in temperature over a period of time.

By using methods and systems disclosed herein for injecting cooled fluid into a well to reduce the temperature at a formation in the well, it can be shown that a reduction in the downhole temperature is linked to a reduction in breakdown pressure due to the thermoelasticity impact. For example, simulation studies have been conducted to evaluate the reduction of in-situ stress and breakdown pressure utilizing thermally controlled fluid at simulated tight gas reservoirs with low permeability of 0.06 md and low porosity of 6%. At such simulated reservoirs, the formation temperature is 300° F. and the minimum horizontal stress gradient is 0.7 psi/ft. The formation temperature in the near wellbore area is reduced by 20° F., 40° F., and 60° F. The simulation results are shown in FIGS. 8 and 9. FIG. 8 shows that the total minimum horizontal stress reduces as the temperature difference increases. FIG. 9 shows that the bottom hole pressure needed to initiate the fracture decreases significantly as the temperature difference increases.

Methods and systems disclosed herein allow for a cost-effective and efficient solution for reducing the breakdown pressure in a well by integrating a cooling system into a hydraulic fracturing system at the surface of the well. For example, in some embodiments, when a tight reservoir formation is encountered in a well, a cooling system may be connected to a hydraulic fracturing system assembled at the surface of the well. A hydraulic fracturing system may include assembled-together hydraulic fracturing equipment provided at the well's surface, such as a fluid source containing a base fluid and fluidly connected to a blender, and a pump and manifold system fluidly connecting an outlet of the blender to a wellhead of the well. A cooling system according to embodiments of the present disclosure may be connected to the hydraulic fracturing system equipment upstream of the pump and manifold system to cool the fluid to a cooled base temperature. The cooled fluid may then be pumped down the well to the tight reservoir formation, where the cooled fluid may lower the downhole temperature and reduce the breakdown pressure of the tight reservoir formation.

In some embodiments, methods and systems may include cooling a base fluid at the surface of a well and combining the cooled fluid with a mixture of chemical additives, acid, and sand to form a cooled fracturing fluid. Further, embodiments disclosed herein relate to pumping the cooled fracturing fluid downhole to a downhole location wherein the cooled fracturing fluid reduces breakdown pressure and improves hydraulic fracturing efficiency. In another aspect, embodiments disclosed herein relate to determining an optimal temperature reduction at a downhole location for hydraulic fracturing efficiency and utilizing a cooling system to lower the temperature of a fracturing fluid to achieve the optimal downhole temperature reduction. In another aspect, methods and systems disclosed herein may be utilized for creating secondary fractures within existing fractures in a subsurface formation during re-frac operations.

FIG. 1 depicts an exemplary well 100 in accordance with one or more embodiments. The well 100 includes a wellhead 104 located on a surface 106 location that may be on the Earth's surface. The wellhead 104 may include a connected tree (e.g., a Christmas tree) having a plurality of valves used to control the flow of fluids into or out of the well and a plurality of connection points used to connect with other well system equipment. For example, the wellhead assembly may control production of fluids that come from the production zone 110 via the wellbore 108, well backpres sure, and/or fluid being injected into the well during a fracturing operation. In one or more embodiments, the production zone 110 may be a tight reservoir formation. However, a person of ordinary skill in the art will be aware that there are alternate embodiments wherein the production zone is not a tight reservoir formation. During a hydraulic fracturing operation, a pipeline 102 may be connected to the wellhead 104 via a frac tree to direct cooled fracturing fluids 109 into the well 100. The well 100 depicted in FIG. 1 is one example of a well 100 but is not meant to be limiting. The scope of this disclosure encompasses any well 100 design, e.g., horizontal wells, vertical wells, or other directional wells, open hole wells (where at least part of the well is uncased), cased wells (e.g., wells having the borehole cased with a casing string cemented in place). Further, the well 100 may have any variation of surface equipment without departing from the scope of this disclosure.

Figure 2:
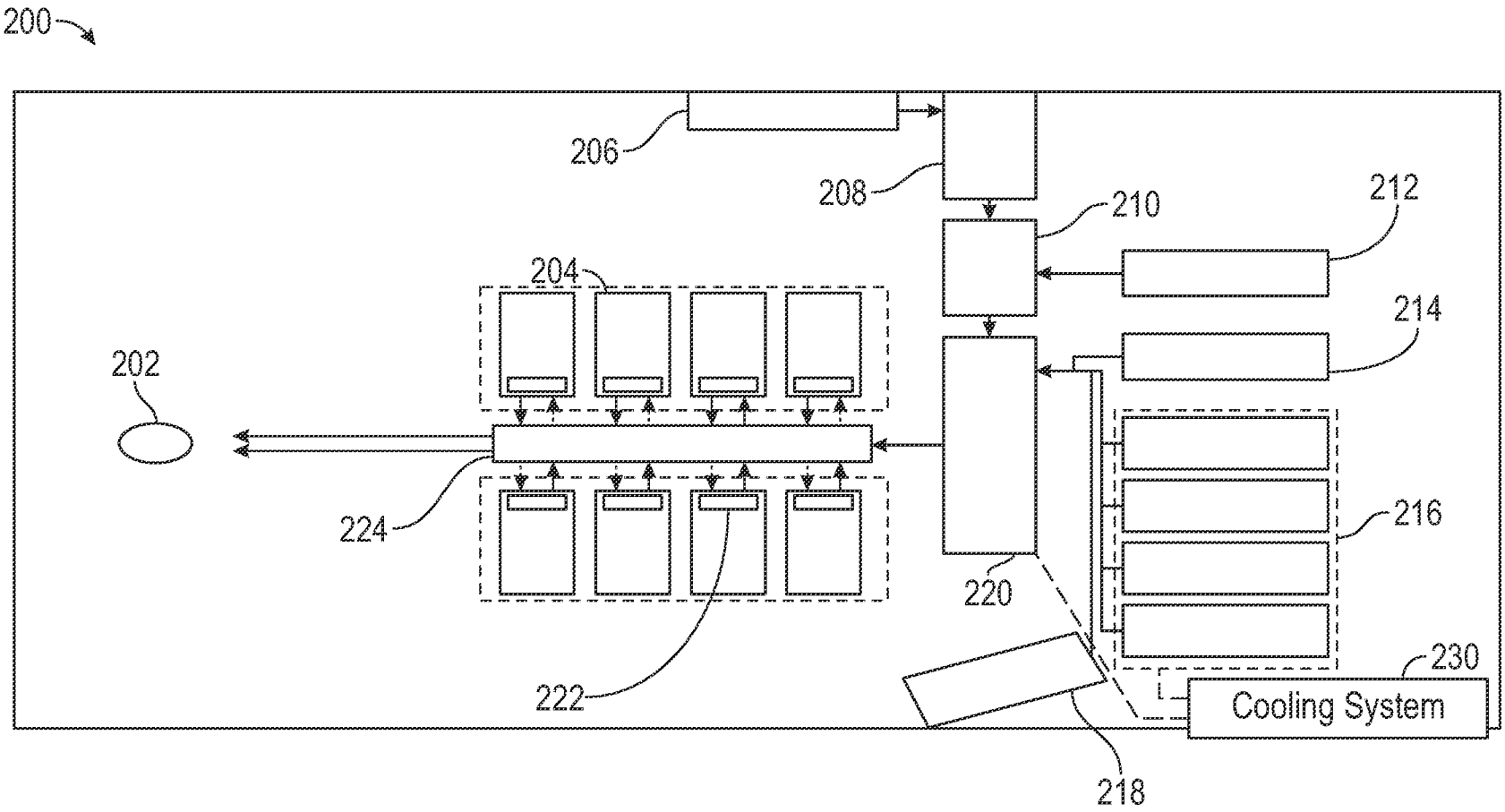
FIG. 2 shows an exemplary hydraulic fracturing site in accordance with one or more embodiments.

FIG. 2 depicts an exemplary hydraulic fracturing site 200 in accordance with one or more embodiments that may be set up at the surface of a well (e.g., well 100 in FIG. 1). The hydraulic fracturing site 200 includes a blender 220, which may combine a multitude of different elements into a fracturing fluid. For example, at least one of chemical additives 218, water 216, and acid 214 may be introduced to the blender 220. Further, a sand transporter 206, frac sanders 208 and a sand conveyor 210 are connected in series. Sand 212 is introduced to the sand conveyor 210, which is connected the blender 220. The blender 220 may combine various combinations of the chemical additives 218, water 216, acid 214, and sand 212 into a homogenous fracturing fluid. The fracturing fluid may then be pumped to a pump and manifold system, which may include a system of connected flow paths, pumps, valves, and other equipment used to pump fluid from the blender 220 to a wellhead 202. For example, as shown in FIG. 2, equipment forming the pump and manifold system may be carried on trucks and/or trailers, where manifold piping, connections, and valves may be held on a manifold trailer 224, and high pressure positive displacement (PD) pumps 222 may be held on frac trucks 204 positioned around the manifold trailer 224 to allow connection between the pumps and manifold. However, other hydraulic fracturing sites may have similar hydraulic fracturing equipment arranged in similar configurations (e.g., different pump/manifold layouts, different amounts of pumps used, etc.).

According to embodiments of the present disclosure, fluid may be cooled using a cooling system 230 that may be connected to fluid-containing equipment in the hydraulic fracturing system located upstream the pump and manifold system to cool fluid prior to being pumped to the wellhead 202. For example, a cooling system 230 may be connected to at least one of a fluid source (e.g., tanks of water 216), piping, and the blender 220. Different examples of cooling systems 230 that may be used in combination with different hydraulic fracturing system equipment are described in more detail below. After fluid is cooled, it may be directed to the pump and manifold system, which may pump the cooled fluid to the wellhead 202.

The manifold trailer 224, which may have a lower pressure inlet and a higher pressure outlet, is fluidly connected to the blender 220 and directs the flow of cooled fluid through a series of frac trucks 204, each having a high pressure PD pump 222. As the cooled fluid is directed through the frac trucks 204, the high pressure PD pumps 222 increase the pressure of the cooled fluid, directing it towards the outlet of the manifold trailer 224. The outlet of the manifold trailer 224 is fluidly connected to a wellhead 202. Pressurized cooled fluid may be pumped from the manifold trailer 224 to a downhole location (e.g., in a production zone 110, as shown in FIG. 1) via the wellhead 202. At such a downhole location, the cooled fluid may be used to accomplish hydraulic fracturing at a downhole formation.

The hydraulic fracturing site 200 depicted in FIG. 2 is one example of a hydraulic fracturing site 200 but is not meant to be limiting. The scope of this disclosure encompasses any hydraulic fracturing site 200 design that combines distinct elements into a fracturing fluid, which may then be pumped to a downhole location. Further, the hydraulic fracturing site 200 may have any variation or combination of fracturing equipment without departing from the scope of this disclosure.

Figure 3:
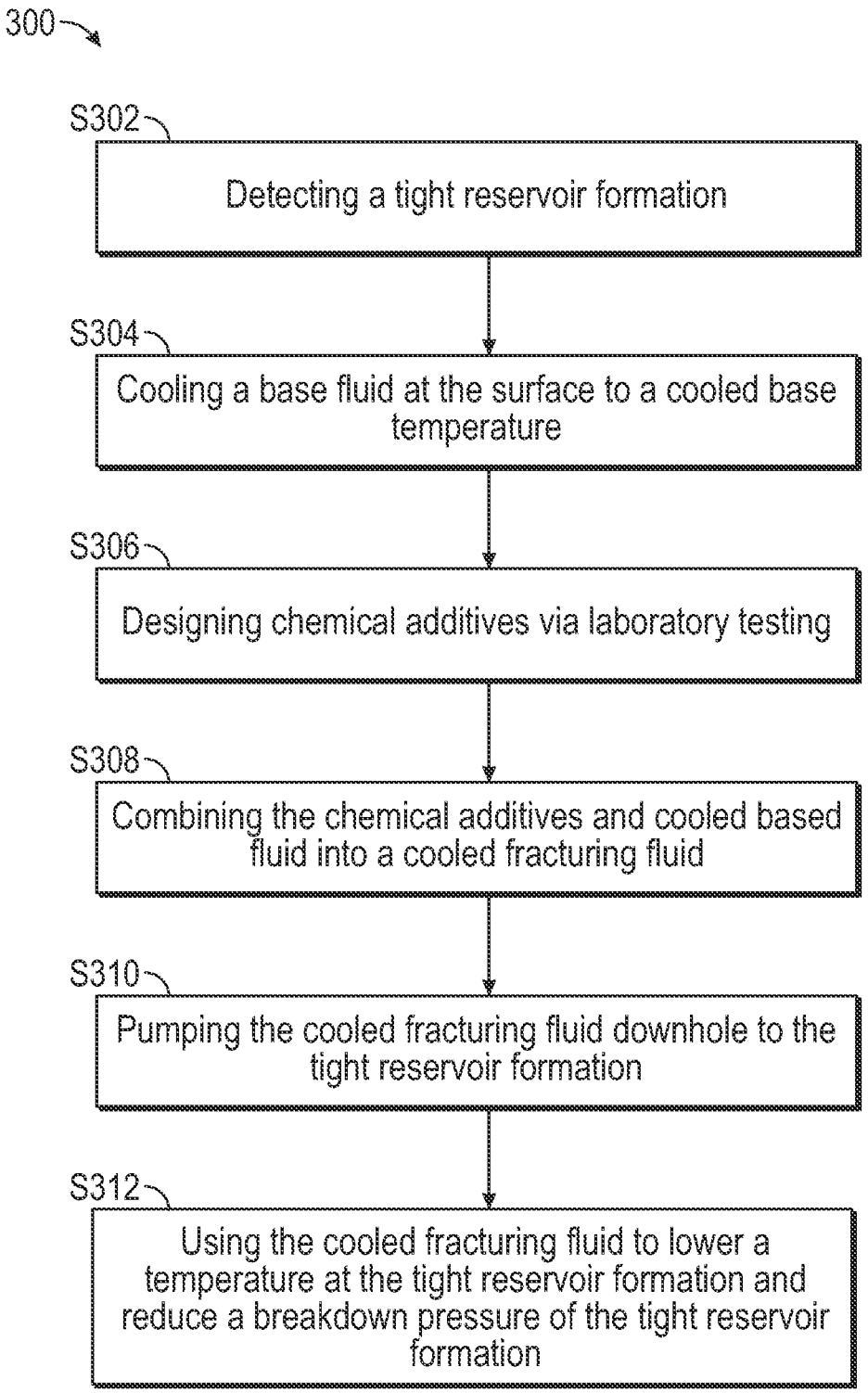
FIG. 3. shows a flowchart in accordance with one or more embodiments.

Turning now to FIG. 3, FIG. 3 depicts a flowchart in accordance with one or more embodiments. More specifically, FIG. 3 depicts a method 300 for improving hydraulic fracturing efficiency using a cooling system. One or more blocks in FIG. 3 may be performed by one or more components as described in the other figures. While the various blocks in FIG. 3 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a tight reservoir formation may be encountered beneath the surface 106 of the Earth, S302. A well 100 may extend from the surface 106 to the tight reservoir formation. A hydraulic fracturing system may be provided at a hydraulic fracturing site 200, located at the surface 106, which may be connected to the well 100 via a wellhead 202. A base fluid may be cooled at the hydraulic fracturing site 200 to a base temperature by a cooling system, S304. In some embodiments, chemical additives 218 may be optimally designed based upon the base temperature of the base fluid. For example, a composition and/or amount of chemical additives may be optimized for compatibility with the base temperature and volume of the base fluid, which may be determined via laboratory testing of the chemical additives at the proposed base temperature, S306. One of ordinary skill of the art will be aware that there are certain mixtures of chemical additives which are suitable for a fracturing fluid with a given temperature.

The cooled fluid may be combined with a designed mixture of chemical additives 218 (e.g., optimized for compatibility with the base temperature) in a blender 220, along with acid 214 and sand 212, into a cooled fracturing fluid, S308. The cooled fracturing fluid may be pressurized by high pressure PD pumps 222 as the fluid flows through the manifold trailer 224 and frac trucks 204. The manifold trailer 224 is fluidly connected to the wellhead 202 (e.g., through pipeline 102 in FIG. 1). The cooled base fluid may be pumped from the manifold trailer 224 to the tight reservoir formation via the wellhead 202 and the wellbore 108, S310. The cooled fracturing fluid may lower the temperature at the tight reservoir formation, which reduces the breakdown pressure at the downhole location, S312. Those skilled in the art will appreciate that a reduction in breakdown pressure may increase the efficiency of hydraulic fracturing operations.

Hydraulic fracturing, as one skilled in the art will be aware, refers to the process of pumping highly pressured fracturing fluid into a formation, causing a fracture to open and extend away from the wellbore. There are some embodiments, as depicted in FIG. 3, wherein a cooled fluid may be mixed with a combination of chemical additives 218, sand 212 and/or acid 214 before being pressurized and pumped downhole. In such embodiments, the cooled fluid, which is highly pressurized, lowers the temperature at the downhole location and creates fractures in the formation, which may be a tight reservoir formation. The chemical additives 218, sand 212, and/or acid 214 may act as proppants, holding open the fractures to allow for ease of production from the formation. There may also be embodiments wherein a cooled fluid is pumped directly downhole without the addition of chemical additives 218, sand 212, acid 214, or other proppants. In such embodiments, the cooled fluid may act as a pre-treatment, cooling the downhole location before a fracturing fluid is pumped downhole for hydraulic fracturing of the formation.

The method 300 depicted in FIG. 3 is one example of a method 300 that may be used to improve efficiency for a hydraulic fracturing operation. However, methods according to embodiments of the present disclosure which involve cooling a fluid at the surface of a well 100 for the purpose of lowering the temperature at a downhole location may be used for other well operations. Additionally, in some embodiments, methods for lowering the temperature at a downhole location by sending a cooled fluid to the downhole location may be designed to lower the downhole formation temperature by a target reduction, which may be selected, for example, to achieve an optimized reduction in breakdown pressure at the downhole location.

For example, according to embodiments of the present disclosure, methods of lowering a downhole formation temperature may include determining an initial downhole temperature at a downhole location in a well (e.g., using downhole temperature sensors or other known method for determining downhole temperatures) and selecting a target temperature reduction at the downhole location. The target temperature reduction may be selected based on, for example, the initial downhole temperature, the initial downhole pressure, an initial breakdown pressure determined at the downhole location, and equipment limitations on equipment used to send a cooled fluid to the downhole location, such as pumping limitations on pumps used to pump the cooled fluid downhole (e.g., a maximum pumping pressure capable from the pumps), and pressure ratings for equipment used to hold or transport the cooled fluid being pumped downhole.

In some embodiments, the target temperature reduction may be selected based on a well operation to be performed at the downhole location. For example, when a cooled fluid pumped downhole to lower the downhole formation temperature is a cooled hydraulic fracturing fluid, the target temperature reduction may be selected to reduce the breakdown pressure of the formation to a sufficiently low level to allow for fracturing to occur and also to reduce the breakdown pressure quickly enough to allow the fracturing to occur in the same step as pumping the cooled hydraulic fracturing fluid to the downhole location. When a cooled fluid pumped downhole to lower the downhole formation temperature is a cooled pretreatment fluid, the target temperature reduction may be selected to reduce and maintain a low enough breakdown pressure to allow for a subsequent hydraulic fracturing step to be performed. Other considerations may be accounted for when using cooled fluid in other well operations to reduce the breakdown pressure at a downhole location.

Parameters for achieving a selected target temperature reduction may be determined based on the well being treated. For example, a temperature change of a fluid as the fluid travels from a surface of the well to the downhole location may be calculated, which may include accounting for frictional and environmental temperature increases as the fluid flows through the well (e.g., heating effects from an increasing temperature gradient along the well, where the downhole temperature generally increases as the depth of the well increases).

The selected target temperature reduction at the downhole location and a calculated temperature change of a fluid as it flows from the surface to the downhole location may be used to determine a maximum initial temperature of which to cool the fluid in order to achieve the target temperature reduction after sending the cooled fluid to the downhole location. In other words, a fluid may be cooled in a hydraulic fracturing system at the surface of the well to an initial temperature, where the initial temperature may be determined from the calculated temperature change to provide the target temperature reduction at the downhole location.

Fluid in a hydraulic fracturing system may be cooled to an initial temperature using a cooling system, e.g., as described herein, connected to one or more equipment units in the hydraulic fracturing system. Once cooled to the initial temperature, the cooled fluid may be pumped down the well to the downhole location to lower the downhole temperature at the downhole location by the target temperature reduction, which thereby may lower the breakdown pressure at the downhole location. In one or more embodiments, the cooled fluid may be injected into the downhole location, which may be a tight gas reservoir, over a period of time at a given rate to cool the downhole location. The period of time and given rate may be simulated and designed in advance in order to best suit the downhole location properties. In such embodiments, after pre-treating the formation with the cooled fluid to lower the breakdown pressure of the formation, a fracturing fluid may then be pumped to the downhole location to accomplish hydraulic fracturing.

In some embodiments, chemical additives 218 may be added to the fluid for use in the well operation being performed with the cooled fluid and/or to help keep the fluid temperature cooled as it flows downhole (e.g., using coolant additives). In embodiments where chemical additives are added to the cooled fluid, the chemical additives may be optimally designed based upon the initial temperature of the fluid. For example, a composition and/or amount of chemical additives may be optimized for compatibility with the initial temperature of the fluid, which may be determined via laboratory testing of the chemical additives at the proposed initial temperature.

As discussed above, different cooling systems may be used to cool a fluid prior to pumping the cooled fluid downhole to lower the downhole formation temperature at a downhole location. Cooling systems may be assembled to an existing hydraulic fracturing system, or a system may be pre-designed and initially assembled with a cooling system at the surface of the well. The type of cooling system used to cool a fluid before pumping down a well may be selected based on, for example, if and what type of pumping system is already being used, the type of fluid being pumped downhole, cooling equipment available, cooling system costs, and/or other factors. Examples of different cooling systems are shown and described with reference to FIGS. 4-7, although other configurations and types of cooling systems may be used.

Figure 4:
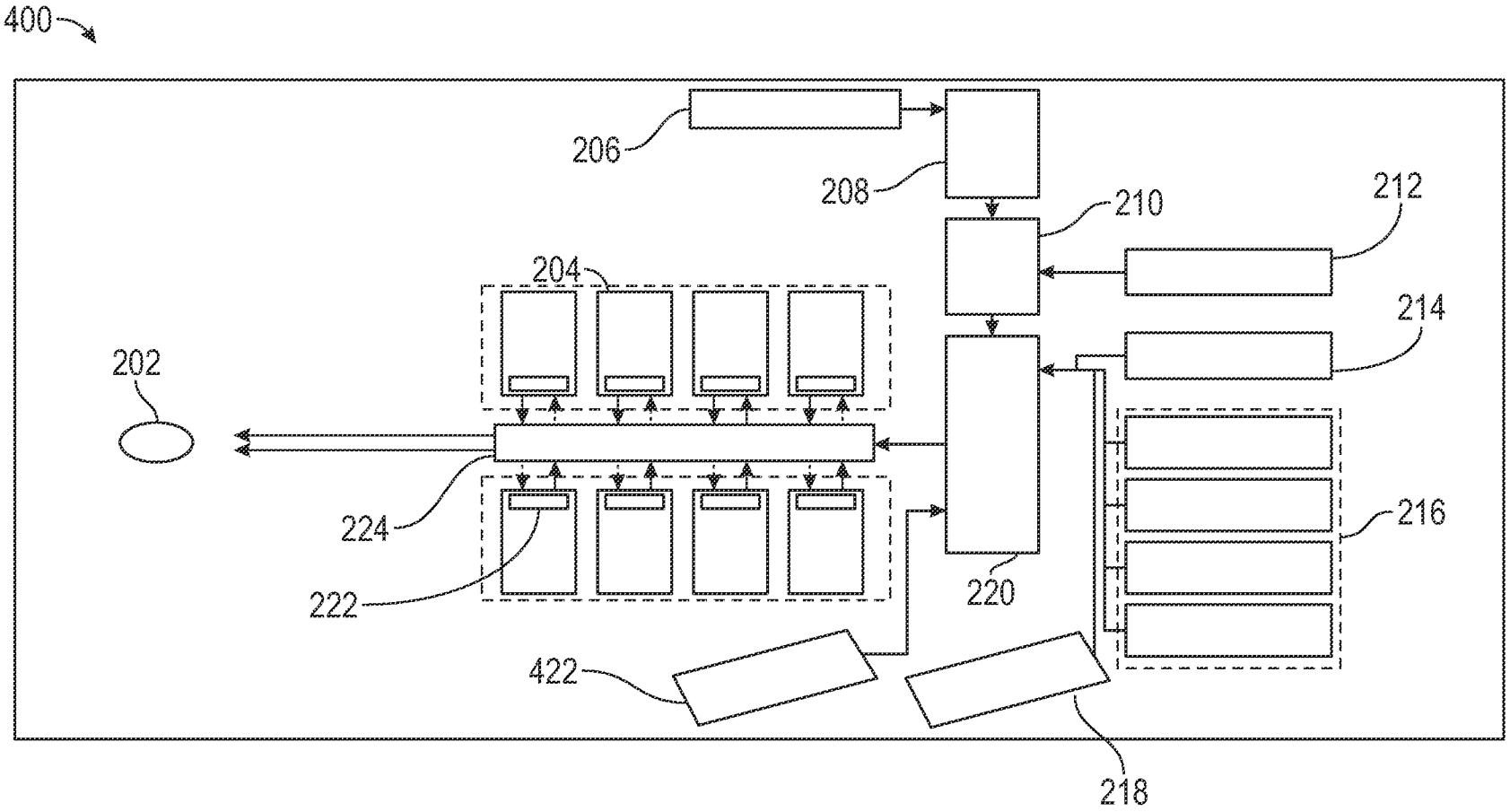
FIG. 4 shows an example hydraulic fracturing system in accordance with one or more embodiments.

FIG. 4 depicts an example system 400 in accordance with one or more embodiments. More specifically, FIG. 4 shows one embodiment of a cooling system connected to an exemplary hydraulic fracturing system 400 at a hydraulic fracturing site 200. In one embodiment, the cooling system may be an ice dispenser 422 connected to the inlet of a blender 220. Ice may be deposited from the ice dispenser 422 into the blender 220, where it may be combined with a fluid (e.g., a fluid mixture of at least one of chemical additives 218, sand 212, acid 214, and water 216) into a homogenous cooled fluid (e.g., a cooled fracturing fluid or a cooled pretreatment fluid). The homogenous cooled fluid may then be pumped downhole to a tight reservoir formation. However, a person of ordinary skill in the art will be aware that there are additional embodiments wherein the ice dispenser 422 may be placed in alternative locations on the hydraulic fracturing site 200. Ice could be dispensed throughout the hydraulic fracturing treatment or, in another embodiment, only in the pad stage without sand.

Figure 5:
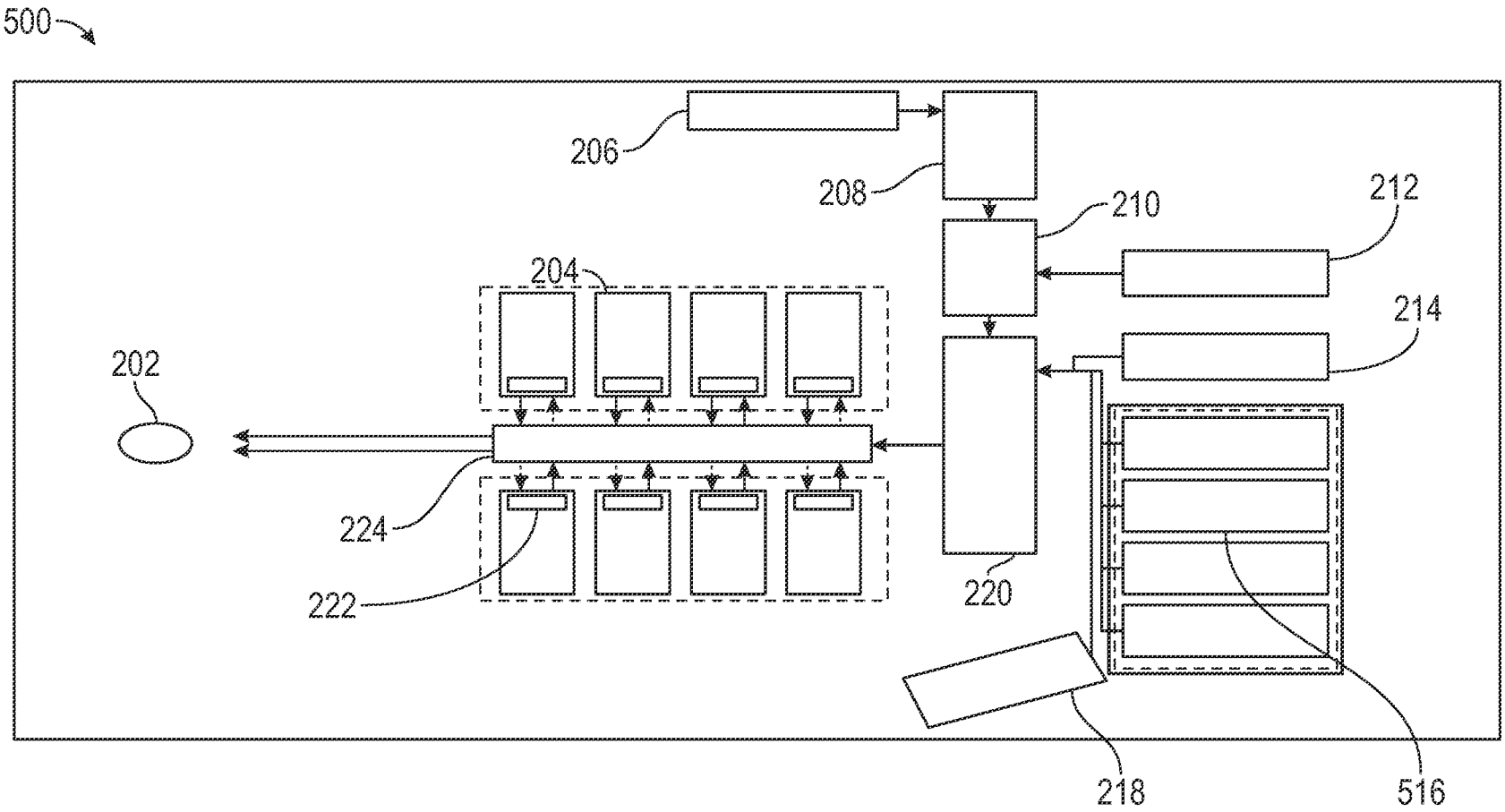
FIG. 5 shows an example hydraulic fracturing system in accordance with one or more embodiments.

FIG. 5 depicts another example system in accordance with one or more embodiments. More specifically, FIG. 5 shows one embodiment of a cooling system connected to an exemplary hydraulic fracturing system 500, where the cooling system may be provided as one or more super insulated tanks 516. Super insulated tanks 516 refer to tanks with various insulation mediums (e.g., Rockwool (a rock-based mineral fiber insulation comprised of basalt rock and recycled slag from by-product of steel and copper) or polyurethane foam) that maintain the temperature of fluids. For example, a super insulated tank may be formed with layer(s) of insulation that prevent more than 5° F. temperature gain in the tank per day. In some embodiments, the super insulated tank(s) 516 may be used to hold a base fluid (e.g., water 216) for fracturing fluid, where the tanks that would have conventionally held the base fluid may be replaced by specialized super insulated tanks 516. In some embodiments, the super insulated tanks 516 may store and maintain the temperature of chilled water, which may be used to form a chilled fracturing fluid.

The super insulated tanks 516 may be fluidly connected to the blender 220 via one or more pipes and valves. In one embodiment, the super insulated tanks 516 are located upstream from the blender 220, where cooled fluid may be directed from the super insulated tanks 516 to the blender 220. In one or more embodiments, the super insulated tanks may be able to transport fluid and maintain water temperature within a given temperature range. Further, due to layers of high-quality insulation, the super insulated tanks may have the ability to extend the temperature maintenance time and reduce temperature variation in the fluid. In embodiments where super insulated tank(s) 516 may hold and cool a water base fluid, chilled water may be pumped into the blender 220, where the chilled water may be combined with chemical additives 218, sand 212, and/or acid 214 into a homogenous cooled fracturing fluid. The homogenous cooled fracturing fluid may then be pressurized and pumped downhole to a tight reservoir formation to lower the breakdown pressure of the tight reservoir formation and hydraulically fracture the formation.

Figure 6:
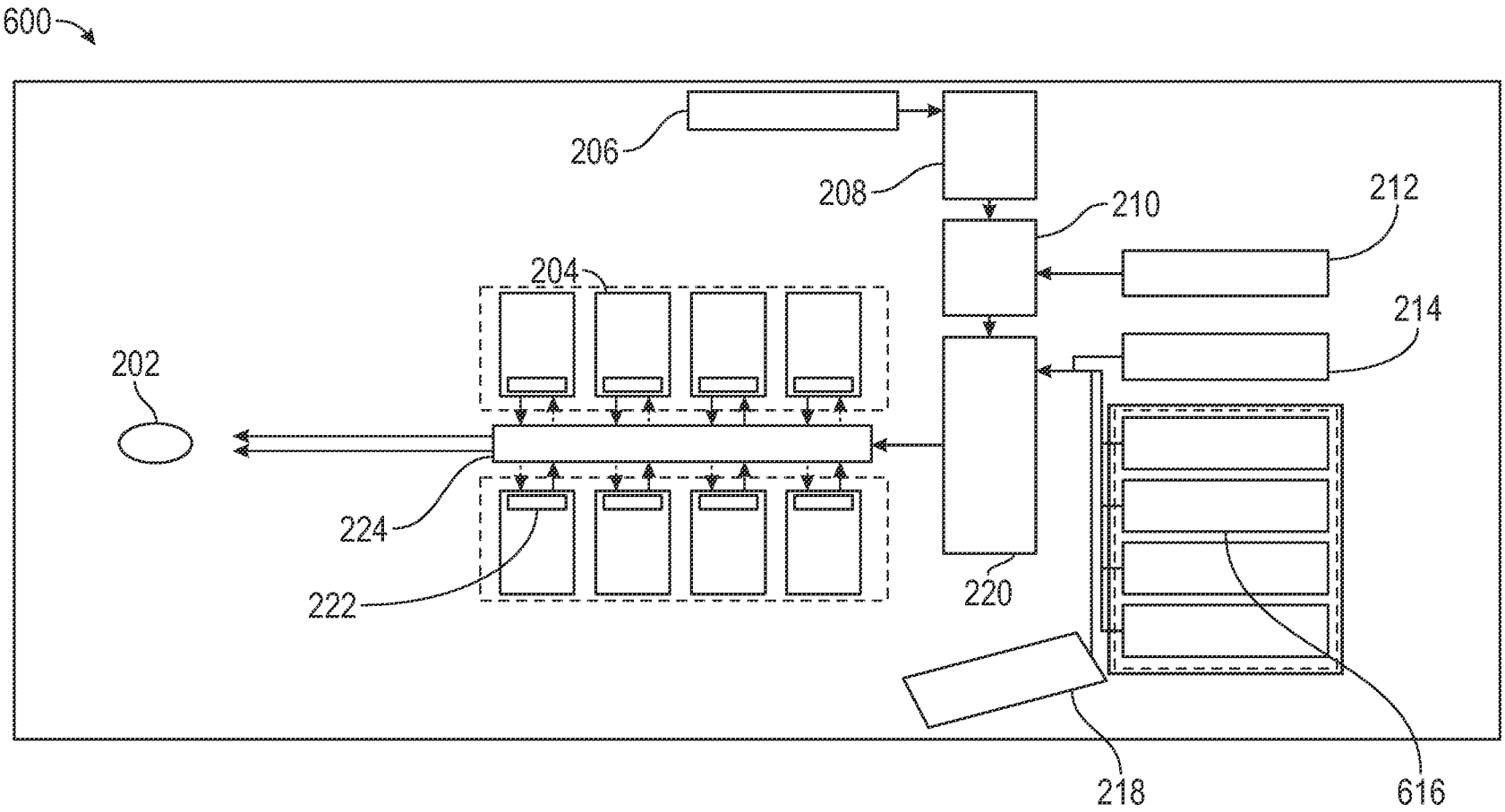
FIG. 6 shows an example hydraulic fracturing system in accordance with one or more embodiments.

FIG. 6 depicts an embodiment of a cooling system connected to a hydraulic fracturing system 600, where the cooling system may be provided as one or more temperature-controlled tanks 616. A temperature-controlled tank 516 may refer to a powered tank which may maintain a temperature of a fluid based on user inputs. In embodiments where the cooling system includes a temperature-controlled tank 616 or a super insulated tank 516, as discussed above, the tanks 616, 516 may also act as a fluid source for the hydraulic fracturing system. For example, fluid to be used in a hydraulic fracturing system may be cooled in and held in a temperature-controlled tank 616 until use of the fluid. The temperature-controlled tanks 616 may hold and cool a base fluid for a fracturing fluid or a pretreatment fluid (e.g., $CO_2$). In some embodiments, tanks used to conventionally hold water 216 may be replaced with temperature-controlled tanks 616, such that the temperature-controlled tanks 616 may cool water 216 (or other fluid) held therein. The temperature-controlled tanks 616 may be fluidly connected to the blender 220 via one or more pipes. In one embodiment, the temperature-controlled tanks 616 may be located upstream from the blender 220, such that cooled fluid from the temperature-controlled tank(s) 616 may be directed to the blender 220 to be mixed with one or more other components. For example, a cooled base fluid pumped into the blender 220 may be combined with chemical additives 218, sand 212, and/or acid 214 into a homogenous cooled fracturing fluid. The homogenous cooled fracturing fluid may then be pressurized and pumped downhole to a tight reservoir formation.

The temperature-controlled tanks 616 may contain an electric powered control box fitted to one side of the tank or fitted to one end of the tank, wherein placement of the control box is variable dependent upon customer preference. The temperature-controlled tanks 616 may maintain fluids at any temperature within a given range. For example, in one embodiment, the given range may be −20° F. to 84° F.

Figure 7:
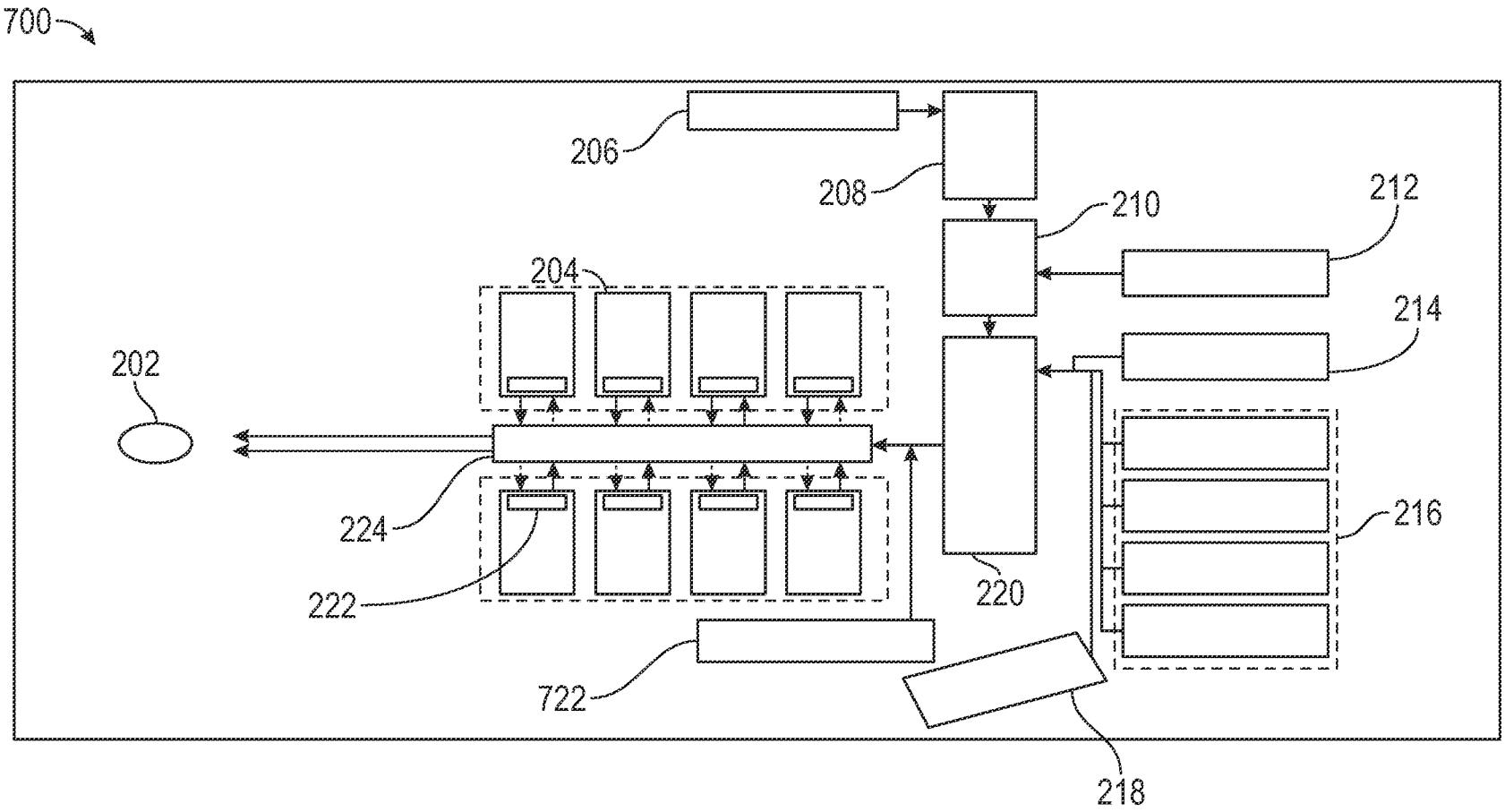
FIG. 7 shows an example hydraulic fracturing system in accordance with one or more embodiments.

Turning to FIG. 7, FIG. 7 depicts an embodiment of a cooling system 722 connected to a hydraulic fracturing system 700, wherein the cooling system 722 is located downstream of a blender 220. In one embodiment, the cooling system 722 may comprise the installation of one or more air-coolers at the outlet of the blender 220. In other embodiments, the cooling system may comprise injecting cooled carbon dioxide, which does not thermally equilibrate with the geothermal gradient at high injection rates. In such embodiments, cooled carbon dioxide could be stored in the temperature-controlled tanks 616, as shown in FIG. 6. However, one of ordinary skill in the art will appreciate that there are many embodiments in which alternate cooling systems 722 may be used in place of the air-coolers. Further, a person of ordinary skill in the art will be aware that the cooling system 722 may be located at alternative locations on the hydraulic fracturing site 200. In additional embodiments, multiple different cooling systems 722 may be combined into one master system to achieve more aggressive and efficient cooling.

The cooling systems depicted in FIGS. 4-7 represent a small number of examples of cooling systems but are not meant to be limiting in any way. Those skilled in the art will be aware that there are many different types of cooling systems which could be present in one or more embodiments of the present disclosure. The scope of this disclosure encompasses any cooling system fluidly connected to a hydraulic fracturing site 200. The cooling system may be placed at any location on the hydraulic fracturing site 200 and connected to any component located on the hydraulic fracturing site 200 without departing from the scope of this disclosure.

Embodiments of the present disclosure may provide at least one of the following advantages. In many situations, the treating pressure required to exceed the breakdown pressure at a formation can reach pumping limitations or completion tubular pressure ratings. An inability to breakdown the formation can result in skipping hydraulic fracturing stages, causing an increase in the cost of operations and a decrease in operation efficiency and hydrocarbon recovery. Embodiments of the present disclosure effectively reduce the breakdown pressure at the formation, thus requiring a lower treating pressure.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method comprising:

detecting a tight reservoir formation in a well;

providing hydraulic fracturing equipment assembled together as a hydraulic fracturing system at a surface of the well, the hydraulic fracturing system comprising:

a fluid source containing a base fluid and fluidly connected to a blender; and a pump and manifold system fluidly connecting an outlet of the blender to a wellhead of the well;

connecting a cooling system to the hydraulic fracturing system;

selecting a target temperature reduction at the tight reservoir formation to reduce a breakdown pressure of the tight reservoir formation;

using the cooling system to cool the base fluid to a cooled base temperature upstream of the pump and manifold system, wherein the cooled base temperature is determined based, at least in part, on the target temperature reduction at the tight reservoir location;

pumping the cooled base fluid down the well to the tight reservoir formation; and using the cooled base fluid to lower a temperature of the tight reservoir formation and reduce the breakdown pressure of the tight reservoir formation.

2. The method of claim 1, wherein the tight reservoir formation has a matrix permeability of less than 1.0 millidarcy.

3. The method of claim 1, further comprising selecting chemical additives based on the cooled base temperature of the base fluid.

4. The method of claim 3, wherein selecting the chemical additives comprises testing the cooled base fluid and determining an optimized mixture of the chemical additives and cooled base fluid.

5. The method of claim 1, wherein cooling the base fluid comprises adding cooled water to the base fluid.

6. The method of claim 5, wherein the base fluid is cooled in a temperature-controlled tank.

7. The method of claim 1, wherein the cooled base fluid lowers the temperature of the tight reservoir formation by at least 40° F.

8. A method, comprising:

determining a downhole temperature at a downhole location in a well;

selecting a target temperature reduction at the downhole location;

calculating a temperature change of a fluid as the fluid travels from a surface of the well to the downhole location;

cooling the fluid in a hydraulic fracturing system at the surface of the well to an initial temperature based on the calculated temperature change to provide the target temperature reduction at the downhole location;

pumping the cooled fluid down the well to the downhole location; and lowering the downhole temperature at the downhole location by the target temperature reduction to lower breakdown pressure at the downhole location.

9. The method of claim 8, wherein the hydraulic fracturing system comprises:

a fluid source fluidly connected to a blender;

a pump and manifold system fluidly connected to the blender and to a wellhead of the well; and a cooling system connected to the hydraulic fracturing system upstream from the pump and manifold system.

10. The method of claim 9, wherein the cooling system comprises a temperature-controlled tank, wherein the temperature-controlled tank cools and maintains the fluid at the initial temperature.

11. The method of claim 9, wherein the hydraulic fracturing system further comprises a chemical additive source connected to the blender, wherein the chemical additive source contains a chemical additive that is selected based on the initial temperature of the fluid.

12. The method of claim 9, wherein the initial temperature is calculated to account for frictional temperature increases as a result of combining the fluid in the blender.

13. The method of claim 9, wherein the cooling system comprises an ice dispenser connected to the blender.

14. The method of claim 8, wherein the fluid comprises carbon dioxide.

15. A system, comprising:

a hydraulic fracturing system, comprising:

a blender;

a pump and manifold system fluidly connected to an outlet of the blender; and a fluid source fluidly connected to an inlet of the blender; and a cooling system connected to the hydraulic fracturing system upstream from the pump and manifold system;

wherein the cooling system is configured to cool a base fluid supplied from the fluid source to a base temperature calculated to reduce a breakdown pressure in a downhole location of a formation.

16. The system of claim 15, wherein the cooling system is located along a fluid connection between the pump and manifold system and the blender.

17. The system of claim 15, wherein the cooling system is connected to the fluid source.

18. The system of claim 15, wherein the cooling system comprises an ice dispenser connected to the blender.

19. The system of claim 15, wherein the cooling system comprises a super insulated tank containing a volume of water that is fluidly connected to the blender.

20. The system of claim 15 wherein the cooling system comprises a temperature-controlled tank containing the fluid source.

* * * * *